US007654090B2

(12) United States Patent
Blomeyer

(10) Patent No.: US 7,654,090 B2
(45) Date of Patent: Feb. 2, 2010

(54) BURNER AND METHOD FOR OPERATING A GAS TURBINE

(75) Inventor: Malte Blomeyer, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 654 days.

(21) Appl. No.: 10/568,120

(22) PCT Filed: Jul. 20, 2004

(86) PCT No.: PCT/EP2004/008115

§ 371 (c)(1),
(2), (4) Date: Oct. 16, 2006

(87) PCT Pub. No.: WO2005/019733

PCT Pub. Date: Mar. 3, 2005

(65) Prior Publication Data

US 2007/0031771 A1 Feb. 8, 2007

(30) Foreign Application Priority Data

Aug. 13, 2003 (EP) ..... 03018408

(51) Int. Cl.
*F02C 1/00* (2006.01)
*F02G 3/00* (2006.01)

(52) U.S. Cl. ..... 60/748; 60/737; 60/742; 60/738

(58) Field of Classification Search ..... 60/737, 60/738, 742, 748
See application file for complete search history.

(56) References Cited

U.S. PATENT DOCUMENTS

| | | | | |
|---|---|---|---|---|
| 5,435,126 | A | 7/1995 | Beaudoin | |
| 6,898,937 | B2 * | 5/2005 | Stuttaford et al. | 60/737 |
| 2001/0052229 | A1 | 12/2001 | Tuthill et al. | |

FOREIGN PATENT DOCUMENTS

| | | | |
|---|---|---|---|
| EP | 0 747 636 | A2 | 12/1996 |
| EP | 1 193 450 | A1 | 4/2002 |
| WO | WO 02/095293 | A1 | 11/2002 |

* cited by examiner

*Primary Examiner*—Michael Cuff
*Assistant Examiner*—Craig Kim

(57) ABSTRACT

The invention relates to a burner having an annular premixing channel in which fuel can be discharged in a radially distributed manner. The radial distribution of the fuel can be regulated during operation of the burner in that fuel can be supplied, independently of one another, into a first and a second part of admission devices having admission holes varying radially in opposite direction by means of fuel supply lines. The invention also relates to a method for operating a gas turbine in which radial distribution of the fuel is regulated in a premixing channel of a burner.

13 Claims, 4 Drawing Sheets

BURNER AND METHOD FOR OPERATING A GAS TURBINE

CROSS REFERENCE TO RELATED APPLICATION

This application is the US National Stage of International Application No. PCT/EP2004/008115, filed Jul. 20, 2004 and claims the benefit thereof. The International Application claims the benefits of European Patent application No. 03018408.9 EP filed Aug. 13, 2003, both of the applications are incorporated by reference herein in their entirety.

FIELD OF THE INVENTION

The invention relates to a burner having an annular premixing channel, into which fuel can be introduced in a radially distributed manner. The invention also relates to a method for operating a gas turbine with a burner having an annular premixing channel.

BACKGROUND OF THE INVENTION

Combustion air and fuel are combined at a burner, mixed and ignited there and burned in a flame. It is generally very important to minimize the emission of pollutants, such as carbon monoxide and nitrogen oxide. Combustion with low levels of nitrogen oxide can be achieved in particular with so-called premix combustion, in which fuel and combustion air are first mixed as homogenously as possible, before being fed to the combustion zone. Such a premix burner is disclosed in WO 02/095293 A1. This burner has an annular premixing channel around a central diffusion burner. Helical blades are disposed in the premixing channel in a helical grid running across the entire cross-section of the premixing channel significantly upstream from the combustion zone. Such a helical grid serves to stabilize the flame. The helical blades of the disclosed helical grid are configured in a hollow manner, with holes extending in a radial direction with helical blades on the surface of the helical blades. Fuel is admitted into the premixing channel from these holes, having been previously fed to the hollow helical blades. This achieves a uniform admission of fuel into the combustion air flowing through the premixing channel over the radial height of the premixing channel. At the same time the admission of fuel from all the helical blades achieves a uniform distribution of fuel in the peripheral direction of the premixing channel. This results in a high level of homogeneity of the combustion air/fuel mixture then flowing into the combustion zone. Such homogeneity is desirable for low nitrogen oxide emissions, as the formation of nitrogen oxide increases exponentially with the flame temperature. A homogenous mixture prevents local peak temperatures, as energy is released in a uniform manner in the mixture. This reduces the formation of nitrogen oxide. Also comparatively little fuel is burned in the combustion air during premix combustion. This so-called lean premix combustion however tends to produce combustion instabilities, i.e. the energy released by the flame fluctuates or the flame can even be extinguished. The central diffusion burner, at which fuel and combustion air are mixed in the flame, serves to stabilize this premix combustion. To achieve further stabilization of the flame stability of the premix flame, it is proposed that flow-blocking elements be provided from the outer edge of the annular premixing channel, to delay the flow of combustion air at certain local points. This results in these zones in an enrichment of the combustion air/fuel mixture with fuel, thus giving rise to local hot strands in the combustion zone, which stabilize premix combustion. This static concept cannot however take into account conditions that change as a function of operation.

SUMMARY OF THE INVENTION

The object of the invention is to specify a burner with an annular premixing channel, the combustion stability of which can be adjusted as a function of prevailing operating conditions.

A further object of the invention is to specify a method for operating a gas turbine, with which a burner is adjusted as a function of the operating state of the gas turbine, such that the highest possible level of flame stability and the lowest possible pollutant emissions result.

The object relating to a burner is achieved according to the invention by a burner oriented along one axis with an annular premixing channel, into which fuel can be introduced in a radially distributed manner, with the radial distribution of the fuel being adjustable during operation of the burner.

The radial distribution of the fuel is the distribution of the fuel along a line perpendicular to the axis of the burner. It is proposed firstly with the invention that the radial distribution of the fuel be configured such that it can be adjusted, so that it is possible to respond to different operating conditions. To date only static fuel distribution has been achieved by means of the geometry and positions of admission of the fuel and combustion air. In contrast the invention is based on the knowledge that pollutant emissions and combustion stability can be influenced favorably by a modified radial distribution of the fuel in different operating conditions. For example during full-load operation every effort is generally made to distribute the fuel as homogenously as possible in the combustion air, to minimize nitrogen oxide emissions. This requires a radial distribution of fuel on admission, which is greater radially outside than inside to supply a larger air mass flow radially outside than radially inside in the annular premixing channel. To achieve uniform fuel concentration over the cross-section of the premixing channel, fuel admission must be greater radially outside than radially inside. In contrast in partial-load operation local enrichment of the fuel/air mixture with fuel can reduce carbon monoxide emissions in comparatively cold zones. Therefore during partial-load operation a radial distribution of fuel on admission is favorable, whereby more fuel is admitted radially inside than radially outside. The radial combustion profile also influences combustion oscillations. Such combustion oscillations result with flame instabilities, which cause pressure fluctuations in a combustion chamber, into which the burner opens. Back-reflection of these pressure fluctuations from the combustion chamber walls into the flame area or into the mixing area for fuel and combustion air with in-phase superimposition can result in a positive feeding back of flame instability and pressure fluctuations, allowing a stable combustion oscillation to be established. This results in a high level of noise emissions and oscillation in the combustion system, which can cause damage. A modification of the distribution profile of fuel admission can interrupt this positive feedback, thereby suppressing the combustion oscillation.

Admission devices are preferably provided in the burner over the periphery of the premixing channel, for the radial admission of fuel at the respective peripheral position by means of admission holes with a respective hole cross-section disposed in the radial direction, with the cross-sections of the holes of a first set of the admission devices increasing toward the axis and the cross-sections of a second set of the admission devices decreasing. Such a configuration allows the required radial distribution of fuel admission to be adjusted as a function of fuel admission on the one hand from the first set of admission devices and on the other hand from the second set of admission devices by means of the opposing variation in the cross-sections of the holes.

The admission devices of the first set and the second set are preferably disposed in an alternating manner along the periphery of the premixing channel. The admission devices of the first and second sets are therefore disposed in an alternating manner next to each other, distributed over the periphery.

The admission devices of the first set and second set preferably follow each other in succession in the axial direction of the premixing channel. In this configuration fuel is admitted first for example from the admission devices of the first set into the premixing channel and then fuel is admitted in the direction of flow from the admission devices of the second set. As a result fuel can be admitted in a uniformly distributed manner with the periphery of the premixing channel in particular both from the admission devices of the first set and also from the admission devices of the second set. Superimposition of fuel admission from the two sets of admission devices produces the required radial distribution for fuel admission as a whole.

A first and a second fuel supply line running around the axis of the burner is preferably provided, with the difference between the fuel pressures in the two fuel supply lines being able to be adjusted in respect of each other as a function of the operating state of the burner. The first set of admission devices is also preferably connected to the first fuel supply line and the second set of admission devices to the second fuel supply line. This configuration makes it possible in a simple manner to adjust fuel admission from the first set and second set of admission devices independently as required. To this end the pressure necessary for the required distribution is adjusted respectively in the first or second fuel supply line. Depending on the pressure difference therefore different quantities of fuel are admitted via the first or second admission device, such that fuel admission as a whole is adjusted to correspond to the required distribution.

The admission devices are preferably small tubes projecting radially into the premixing channel, to the inside of which fuel is supplied. The fuel is then admitted into the premixing channel from these small tubes out of the admission holes.

The admission devices are preferably helical blades projecting radially into the premixing channel, to the inside of which fuel is supplied. In this instance the admission holes are disposed on the surface of the helical blades, preferably in proximity to a front edge of the blade. The helical blades therefore have a double function of providing the twist required to stabilize combustion and at the same time operating as an admission device for the fuel.

The first set of admission devices is preferably made up of small tubes projecting radially into the premixing channel and the second set of admission devices is preferably made up of helical blades projecting into the premixing channel. Both the first set and the second set of admission devices can thereby be disposed upstream of the respective other set in the premixing channel. It is favorable that the small tubes should be disposed upstream of the helical blades, resulting in more thorough mixing of fuel and combustion air as they pass through the helical grid. For greater protection against flashback it may however be more favorable for the small tubes to be disposed downstream of the helical blades.

The burner is preferably a gas turbine burner, in particular for a stationary gas turbine with an output greater than 50 MW. A gas turbine has a compressor, where the air is highly compressed and fed to the burner. The burner opens into a gas turbine combustion chamber, in which the burner flame is enclosed. The hot waste gas generated in the combustion chamber then flows into a turbine section, in which hot gas flows around the turbine blades. Blades disposed on a turbine shaft are driven by the hot gas to rotate the turbine shaft. In the case of large stationary gas turbines in particular there are strict requirements relating to low pollutant emissions and a reduced tendency to produce combustion oscillations.

The burner preferably has a central diffusion burner enclosed by the premixing channel.

The object relating to a method is achieved according to the invention by specifying a method for operating a gas turbine with a burner for burning a fuel in air, said burner having an annular premixing channel, into which the fuel is introduced in a radially distributed manner, with the radial distribution being adjusted as a function of the operating state of the gas turbine.

The advantages of this method result according to the above statements relating to the advantages of the burner.

During partial-load operation of the gas turbine the radial distribution is preferably adjusted such that a range of a local maximum is established in the radial distribution of the fuel concentration in the fuel/air mixture.

During full-load operation of the gas turbine the radial distribution is preferably adjusted such that a homogenous concentration of fuel and air results in the mixture.

If a combustion oscillation occurs with an amplitude that exceeds a predefined limit value, the radial distribution is preferably modified.

BRIEF DESCRIPTION OF THE DRAWINGS

The invention is described in more detail below with reference to an example based on the drawings, which are schematic and not to scale, in which.

DETAILED DESCRIPTION OF THE INVENTION

Figure 1:
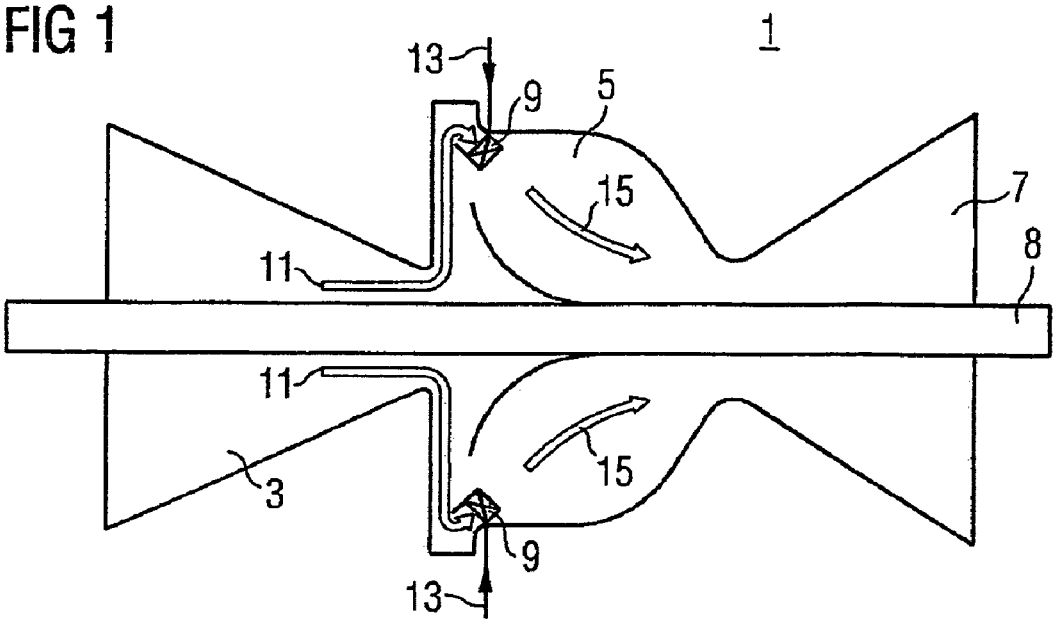
FIG. 1 shows a gas turbine.

The same reference characters have the same significance in the various figures.

FIG. 1 shows a gas turbine 1. The gas turbine 1 has a compressor 3 and a turbine section 7 disposed on a common turbine shaft 8. An annular combustion chamber 5 is connected between the compressor 3 and the turbine section 7. A set of premix burners 9 distributed around the periphery opens into the annular combustion chamber 5. Air 11 is supplied in a highly compressed manner to the premix burners 9 from the compressor 3. Fuel 13 is also fed to the premix burner 9. Air 11 and fuel 13 are mixed and introduced via the premix burner 9 into the combustion chamber 5, where they are burned to form a hot gas 15.

Figure 2:
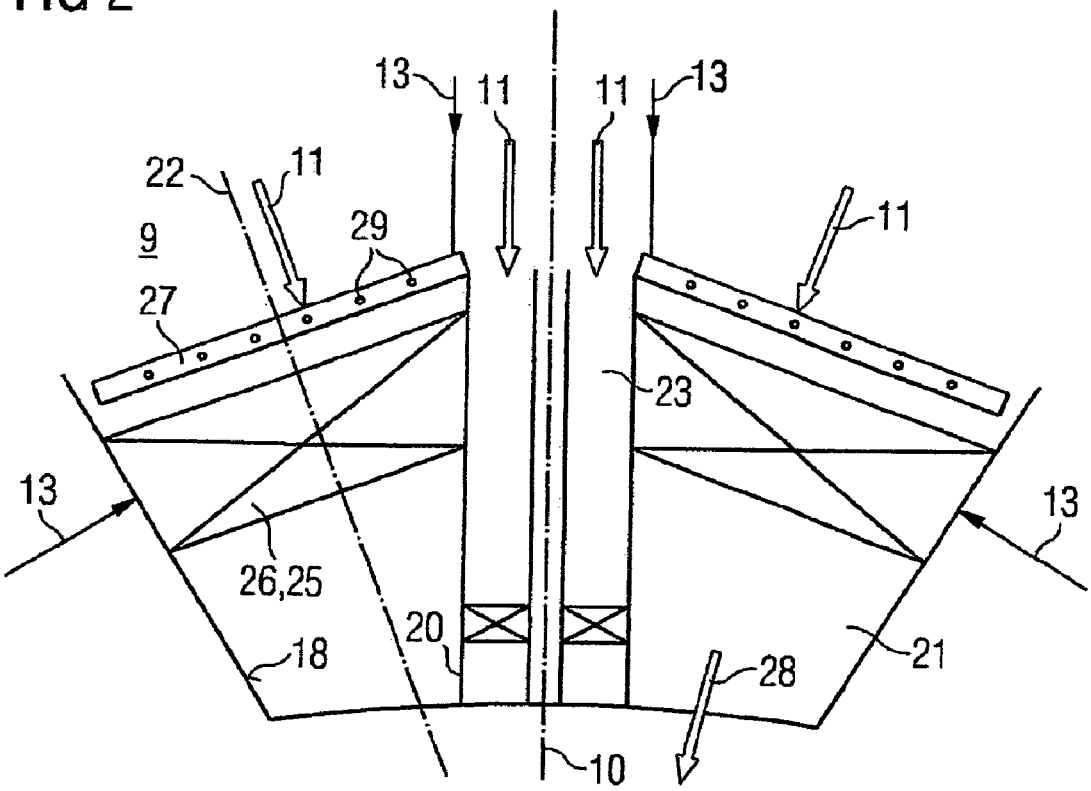
FIG 2 Prior art
FIG. 2 shows a premix burner according to the prior art.

FIG. 2 shows a premix burner 9. This is oriented along an axis 10. The premix burner 9 has an annular premixing channel 21. The premixing channel 21 surrounds a central diffusion burner 23. The premixing channel 21 has an annular central surface 22, which in cross-section forms an angle with the burner axis 10. The premixing channel 21 has a radially outside outer surface 18 and a radially inside inner surface 20. An annular helical grid 25 made up of individual helical blades 26 extends in a radial direction over the entire cross-section of the premixing channel 21, i.e. perpendicular to the central surface 22 of the premixing channel 21. Fuel admission tubes 27 project out in a radial direction from the diffusion burner 23 into the premixing channel 21. The fuel admission tubes 27 are configured as hollow and have admission holes 29.

In the case of the burner according to the prior art in FIG. 2, air 11 is guided through the premixing channel 21. The air 11 flows past the fuel admission tubes 27. Fuel 13 is fed inside the fuel admission tubes 27, passing out of the admission holes 29 into the air 11. The air 11 is twisted by means of the helical blades 26 in the helical grid 25, which serves to stabilize combustion. The helical blades 26 are configured such that fuel 13 can also be supplied to them. Fuel 13 is also admitted into the air 11 in the premixing channel 21 via admission holes (not shown in more detail) on the surface of the helical blades 26. Fuel 13 and air 11 are mixed in the premixing channel 21 to form a fuel/air mixture 28, which exits from the premix burner 9 and is burned there in a combustion zone. If premix combustion is lean, i.e. if there is relatively little fuel 13 in the air 11, such premix combustion tends to result in instabilities in the flame, i.e. there are fluctuations in the flame or the flame is even extinguished. The central diffusion burner 21, to which air 11 and fuel 13 are also supplied, is frequently used to stabilize such combustion. These are essentially mixed together first in the combustion zone, with a richer mixture being selected. Premix combustion can be stabilized using the flame of the diffusion burner 23. In the case of the premix burner 9 shown in FIG. 2, fuel 13 is introduced into the premixing channel 21 in a permanently and statically distributed manner.

Figure 3:
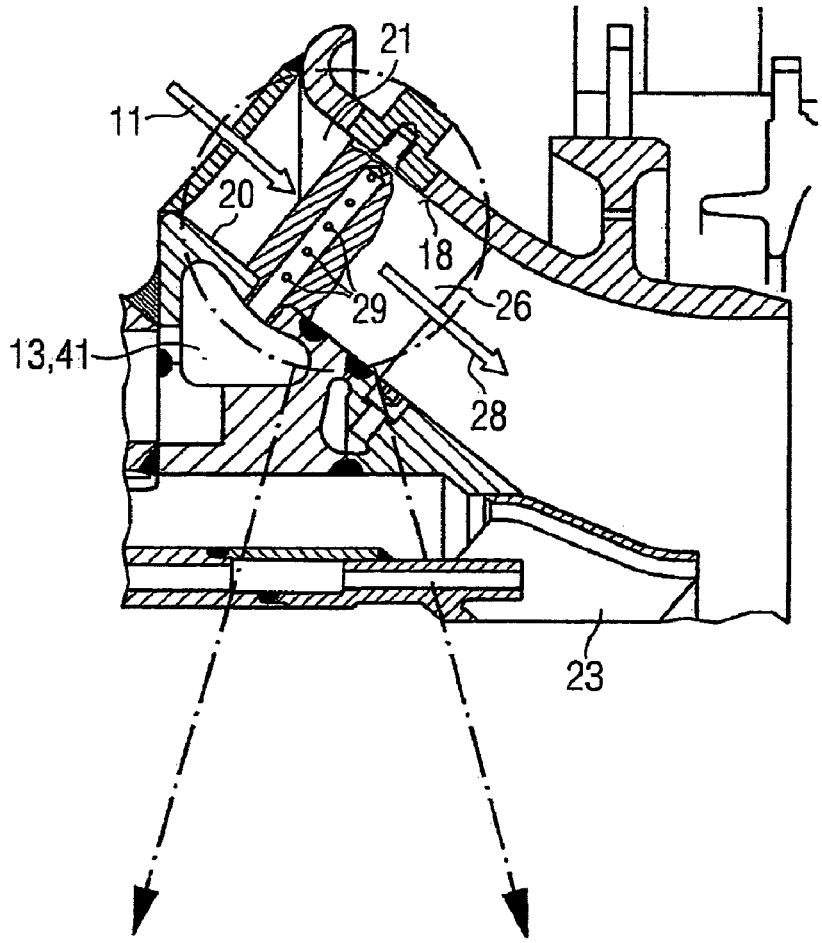
FIG 3 Prior art
FIG. 3 shows a longitudinal section through a premixing channel of a premix burner according to the prior art.

FIG. 3 shows a segment of a longitudinal section through a premixing channel according to the prior art. It shows a section through a helical blade 26 of the helical grid 25. An annular fuel supply line 41 is disposed [lacuna] from an annular radially inside [lacuna] i.e. in the area of the inner surface 20 of the premixing channel 21. Fuel 13 is fed from this annular fuel supply line 41 to the helical blades 26. The helical blades 26 all have the same arrangement and the same hole cross-section at their admission holes 29.

Figure 4:
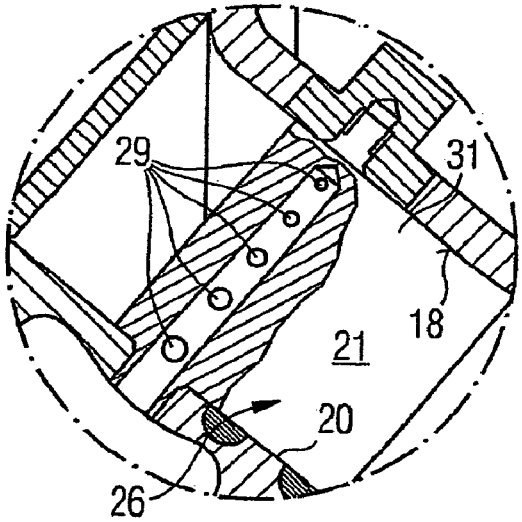
FIGS. 4,5 show a segment of a longitudinal section through a premixing channel.
Figure 5:
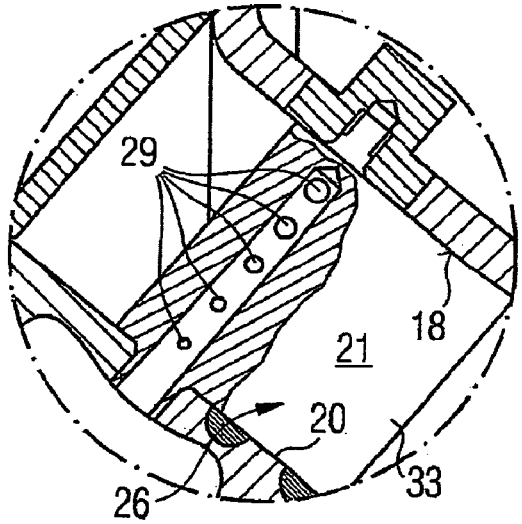

FIG. 4 shows a segment of a longitudinal section through the premixing channel 21 in an arrangement that is different from the one in FIG. 3, which becomes clear in conjunction with FIG. 5. FIG. 4 and FIG. 5 each show a section through two adjacent helical blades 26, i.e. FIG. 4 shows a first helical blade 26 and FIG. 5 shows a helical blade 26 adjacent thereto. In the case of the helical blade 26 in FIG. 4, the hole cross-sections of the admission holes 29 vary, the hole cross-sections toward the inner surface 20 of the premixing channel 21, i.e. toward the axis 10 (not shown here), being larger. In contrast the hole cross-sections of the admission holes 29 of the helical blades 26 shown in FIG. 5 are smaller in the same direction. Thus the hole cross-sections of the admission holes 29 vary in the opposing direction for two respectively adjacent helical blades 26 of the helical grid, i.e. a blade 26 with admission holes 29 that increase in size toward the axis 10 is followed respectively by a helical blade 26 with admission holes 29, the hole cross-sections of which decrease toward the axis 10. The helical blades 26 in FIG. 4 thereby form a first set 31 of admission devices for the admission of fuel 13 into the premixing channel 21. The helical blades 26 in FIG. 5 form a second set 33 of admission devices for the admission of fuel 13 into the premixing channel 21.

Figure 6:
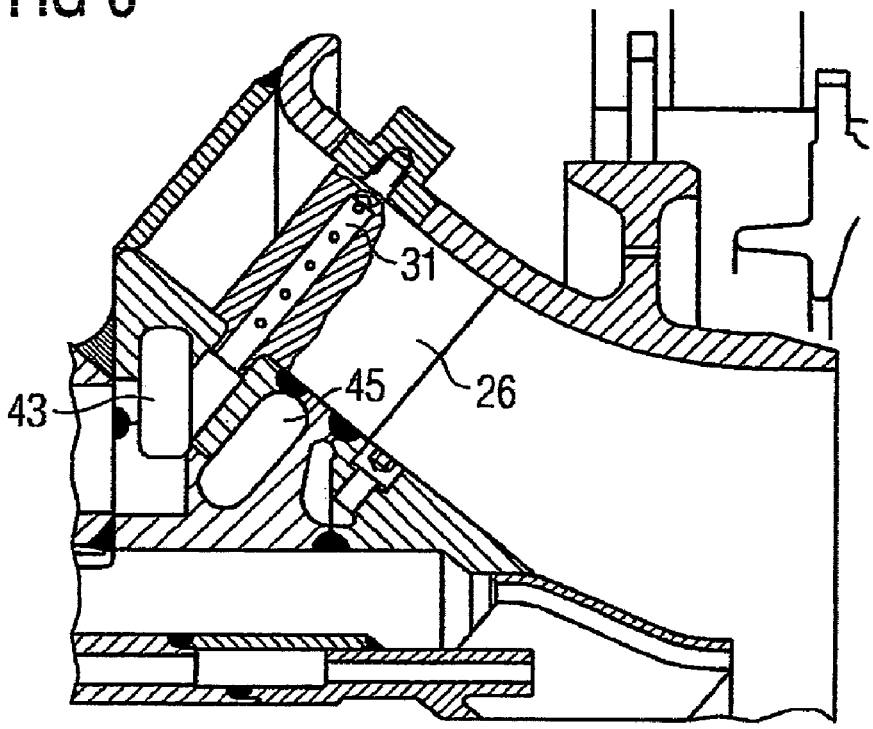
FIGS. 6,7 show a longitudinal section through a premixing channel.
Figure 7:
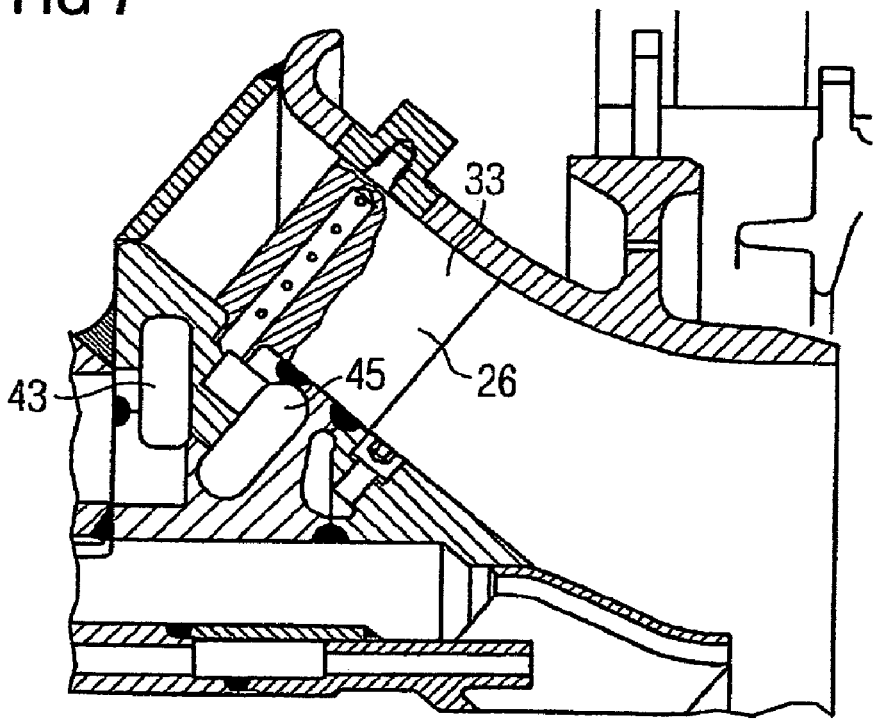

FIGS. 6 and 7 show how the admission devices 31, 33 are supplied with fuel 13. The first set 31 of admission devices is supplied from an annular fuel supply line 43, which is disposed between the diffusion burner 23 and the premixing channel 21. The second set 33 is supplied with fuel 13 by a second, independent annular fuel supply line 45. The second annular fuel supply line 45 is disposed immediately adjacent to the first fuel supply line 43.

With the configuration thus introduced it is now possible for the first time to modify the radial distribution of fuel in the premixing channel 21 during operation of the burner. This is achieved by varying the supply of fuel to the admission devices 31, 33 via the fuel supply lines 43, 45. The opposing variation in the hole cross-sections in the admission devices 31, 33 makes it possible to set almost any required radial distribution of fuel 13 in the premixing channel 21. For example during partial-load operation more fuel can be supplied to the first set 31 of admission devices, resulting in fuel enrichment toward the inner surface 20 of the premixing channel 21 due to the fact that the hole cross-sections of the admission holes 28 increase toward the axis 10. This favorably allows a reduction in carbon monoxide production to be achieved by means of local enrichment. In contrast during full-load operation for example more fuel can be supplied to the second set of admission devices, resulting in a more homogenous distribution of fuel 13 in the premixing channel 21. The admission holes 29, which increase toward the outer surface 18 of the premixing channel 21, take into account a mass flow of air 11 in the radially outside section toward the outer surface 18 in the premixing channel 21, such that these increasing hole cross-sections are used to adjust the radial distribution of fuel 13 in the premixing channel 21, resulting in the most homogenous mixture possible of fuel 13 and air 11. The radial distribution of the fuel 13 could also be modified, if a combustion oscillation that exceeds a specified limit amplitude occurs in the combustion chamber 5. Such combustion oscillations can result from flame instabilities and the feeding back of pressure fluctuations and close fluctuations in the fuel/air mixture. By varying the radial distribution of the fuel 13 in the air 11 it is possible to interrupt this feedback mechanism, thereby suppressing the combustion oscillations.

Figure 8:
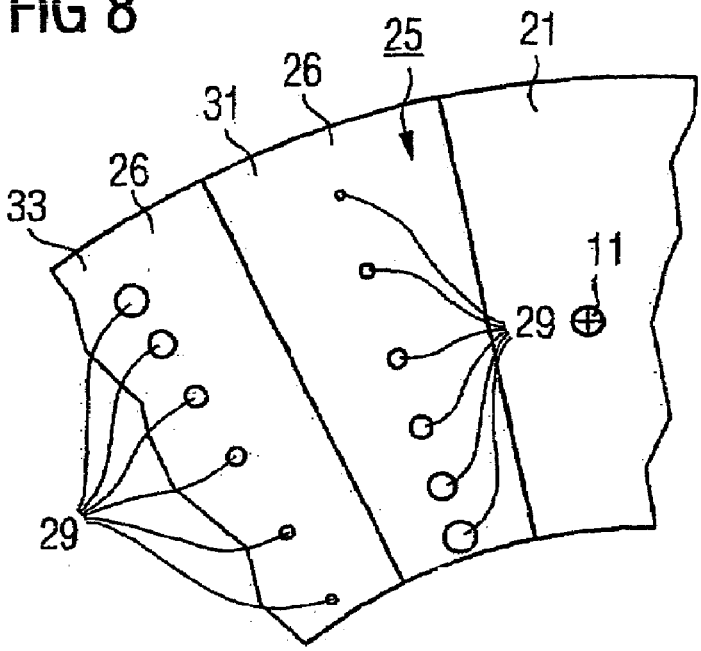
FIG. 8 shows a segment of a cross-section through a premixing channel.

FIG. 8 once again shows a segment of a cross-section through the premixing channel 21 to illustrate the alternating arrangement of the first set 31 of admission devices and the second set 33 of admission devices, configured respectively as helical blades 26 in the helical grid 25. It shows the opposing variation in the hole cross-sections of the admission holes 29 in the radial direction.

Figure 9:
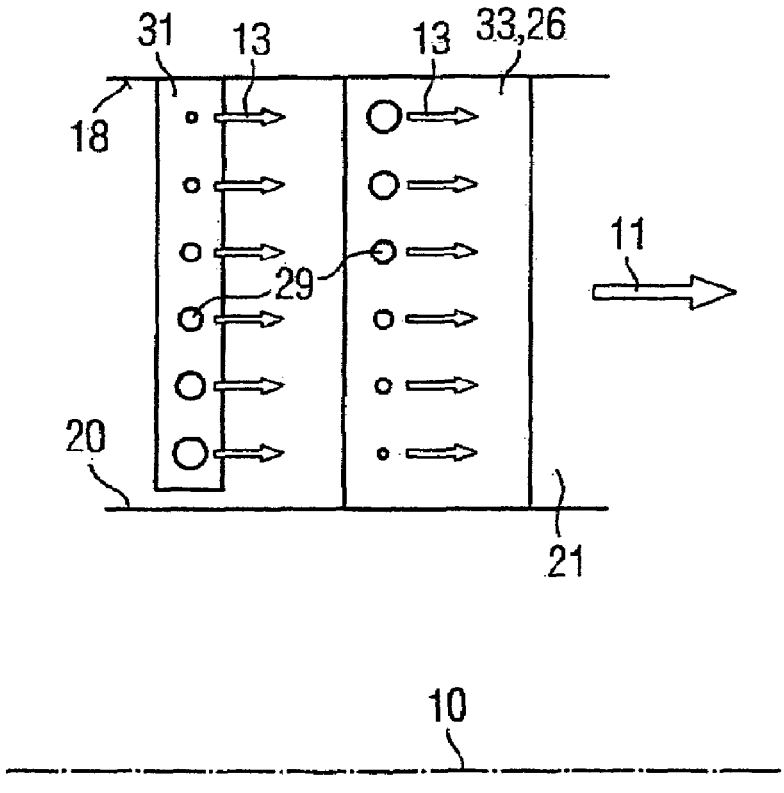
FIG. 9 shows a segment of a longitudinal section through a premixing channel.

FIG. 9 shows a further possible configuration of the arrangement of the first set 31 and second set 33 of admission devices. A segment through a longitudinal section through the premixing channel 21 shows the first set 31 and second set 33 of admission devices disposed one behind the other in the direction of flow of the air 11. The first set 31 is hereby made up of small tubes, which project into the premixing channel 21. The second set 33 is made up of helical blades 26. The hole cross-sections of the admission holes 29 again vary in an opposing manner, i.e. the admission holes 29 of the first set 31 of admission devices increase toward the axis 10 or toward the inner surface 20, while the hole cross-sections of the admission holes 29 of the second set 33 of admission devices reduce toward the axis 10. This axial graduation of the first set 31 and second set 33 of admission devices allows fuel 13 to be introduced very uniformly in the premixing channel 21 even in the peripheral direction.

The invention claimed is:

1. A burner oriented along an axis, comprising an annular premixing channel that a fuel is introduced in a radically distributed manner, the radical distribution of the fuel being adjustable during operation of the burner; and admission devices distributed over the periphery of the premixing channel for the radical admission of the fuel at the respective peripheral position by a plurality of admission holes disposed in the radial direction with a respective hole cross-section, wherein the hole cross-section of a first set of admission devices increases toward the axis and the hole cross-sections of a second set of admission devices decreases toward the axis.

2. The burner according to claim 1, wherein the admission holes of the first set and second set are disposed in an alternating manner along the periphery of the premixing channel.

3. The burner according to claim 1, wherein the admission devices of the first set and second set are arranged to follow each other in succession in the axial direction of the premixing channel.

4. The burner according to claim 1, wherein a first and a second fuel supply line extending around the axis with a pressure difference between the fuel pressures in the two fuel supply lines being adjustable in respect of each other as a function of the operating state of the burner.

5. The burner according to claim 4, wherein the first set of admission devices is connected to the first fuel supply line and the second set of admission devices is connected to the second fuel supply line.

6. The burner according to claim 1, wherein the admission devices are small tubes projecting radially into the premixing channel and supply the fuel into the premixing channel.

7. The burner according to claim 1, wherein the admission devices are helical blades projecting radially into the premixing channel and supply the fuel into the premixing channel.

8. The burner according to claim 3, wherein the first set of admission devices comprises small tubes projecting radially into the premixing channel and the second set of admission devices comprises helical blades projecting radially into the premixing channel.

9. The burner according to claim 1, wherein the burner is configured as a gas turbine burner for a stationary gas turbine with an output greater than 50 MW.

10. The burner according to claim 1, wherein the burner has a central diffusion burner enclosed by the premixing channel.

11. A method for operating a gas turbine, comprising: providing a burner for burning fuel in air, the burner having an annular premixing channel, including admission devices distributed over a periphery of the premixing channel for radial admission of fuel at the respective peripheral position by a plurality of admission holes disposed in the radial direction with a respective hole cross-section, the hole cross-section of a first set of admission devices increases toward the axis and the hole cross-sections of a second set of admission devices decreases toward the axis; and introducing the fuel into the burner in a radially distributed manner with the radial distribution adjusted as a function of an operating state of the gas turbine, wherein that during full-load operation of the gas turbine radial distribution is adjusted such that a homogenous concentration of the mixture of fuel and air results.

12. The method according to claim 11, wherein during partial-load operation of the gas turbine the radial distribution is adjusted such that a range of a local maximum is established in the radial distribution of the concentration of fuel in the fuel/air mixture.

13. The method according to claim 11, wherein the radial distribution is modified if a combustion oscillation occurs with an amplitude that exceeds a predefined limit value.

* * * * *

UNITED STATES PATENT AND TRADEMARK OFFICE

CERTIFICATE OF CORRECTION

PATENT NO. : 7,654,090 B2
APPLICATION NO. : 10/568120
DATED : February 2, 2010
INVENTOR(S) : Malte Blomeyer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 779 days.

Signed and Sealed this

Twenty-third Day of November, 2010

David J. Kappos

David J. Kappos
*Director of the United States Patent and Trademark Office*